US006877353B2

(12) United States Patent
Rassette et al.

(10) Patent No.: US 6,877,353 B2
(45) Date of Patent: Apr. 12, 2005

(54) DIE BUTTON EXTRACTOR

(75) Inventors: Gary C. Rassette, Roseville, MI (US); Kevin M. Lutz, Harrison Township, MI (US)

(73) Assignee: KeGar Technologies, LLC, Allentown, MI (US)

( * ) Notice: Subject to any disclaimer, the term of this patent is extended or adjusted under 35 U.S.C. 154(b) by 0 days.

(21) Appl. No.: 10/691,206

(22) Filed: Oct. 22, 2003

(65) Prior Publication Data

US 2004/0226339 A1 Nov. 18, 2004

Related U.S. Application Data

(63) Continuation-in-part of application No. 10/437,359, filed on May 13, 2003.

(51) Int. Cl.[7] ..... F16B 2/14; F16B 2/18; B21J 13/02; B26D 7/26

(52) U.S. Cl. ..... 72/482.93; 72/448; 83/698.11

(58) Field of Search ..... 72/481.1, 481.9, 72/482.92, 482.93, 448; 83/686, 689.11, 690

(56) References Cited

U.S. PATENT DOCUMENTS

| | | | | | |
|---|---|---|---|---|---|
| 2,377,191 | A | * | 5/1945 | Teachout | 72/482.92 |
| 3,640,170 | A | * | 2/1972 | Bennett | 83/698.11 |
| 3,797,352 | A | * | 3/1974 | Smith | 83/698.11 |
| 3,848,452 | A | * | 11/1974 | Gargrave | 72/448 |
| 4,103,574 | A | * | 8/1978 | Greer | 83/698.11 |
| 4,610,185 | A | * | 9/1986 | France | 83/685 |
| 6,669,399 | B2 | * | 12/2003 | Janek, Jr. | 83/698.11 |
| 2004/0101373 | A1 | * | 5/2004 | Isaksson et al. | 83/698.11 |

* cited by examiner

*Primary Examiner*—David Jones
(74) *Attorney, Agent, or Firm*—Liell & McNeil; Jonathan F. Yates

(57) ABSTRACT

The present invention provides a die button assembly for locating a die button relative to a body die, and for facilitating removal of the die button from the body die. The assembly includes a substantially cylindrical button having a volumetrically reduced region and a complementary, internally threaded die button extractor having a foot portion extending into the volumetrically reduced region and facilitating removal of the button from the body die via an upward force applied to the internally threaded portion.

16 Claims, 2 Drawing Sheets

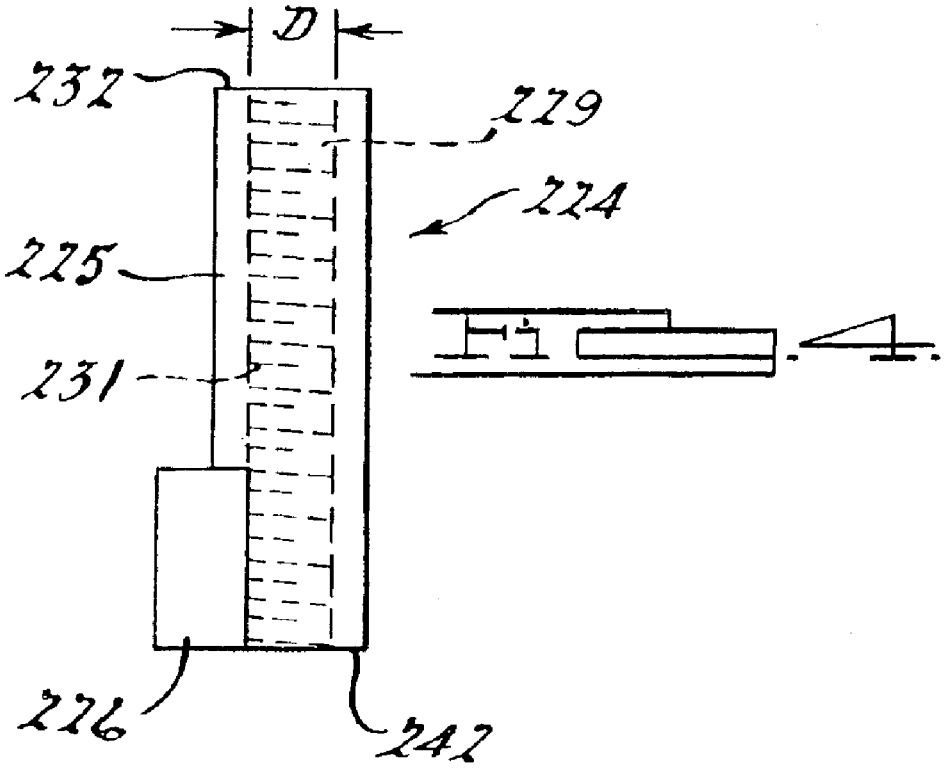
D
232
229
224
225
231
226
242

DIE BUTTON EXTRACTOR

CROSS REFERENCE TO RELATED APPLICATIONS

This Application is a Continuation-in-Part of Co-Pending U.S. patent application Ser. No. 10/437,359, Filed May 10, 2003 and Incorporated By Reference Herein in its Entirety

TECHNICAL FIELD

The present invention relates generally to dies for stamping and punching, and to tools and processes for die button removal. More particularly, the present invention relates to a punch die button and related assembly adapted for rotationally locating the button in a body die, and for facilitating removal of the button therefrom.

BACKGROUND OF THE INVENTION

Stamping and punching processes have long been integral to manufacturing. In a manufacturing plant, there may be hundreds or even thousands of stamping and punching tools. One needs to look no further than the multitude of punched holes in an automobile body to appreciate the importance of punching and stamping operations to modem manufacturing. In a typical punching process, a punch made from a hardened steel alloy is reciprocably located above a body die or platen. A metal sheet/stock or other workpiece is passed below the punch, and the punch is actuated to move downward and pierce a "slug" from the workpiece. Depending on the purpose for punching the workpiece, various hole shapes may be desirable. For instance, where the workpiece is punched for receipt of a conventional fastener, a substantially circular hole may be appropriate. In contrast, other applications such as holes for routing wiring, conduits, or holes for receipt of various plastic mounting members may call for more complex shapes. Different punches are commercially available, having a wide variety of shapes to the working point of the punch, accordingly forming different shaped holes in the workpiece.

The portion of the punching apparatus complementary to the punch comprises the main or lower die. When the punch is moved to a downward position, it is generally desirable to provide a shaped die portion that receives the working point and a portion of the shank of the punch, supporting the punch against lateral deflection and/or breaking as it pierces the workpiece. The prevailing approach in the industry has been to provide a "die button" that is a substantially cylindrical piece press-fit into a bore in the larger, main body die. By forming the die button with a diameter that is very slightly greater than the diameter of the bore, and pressing the button therein, the risk of the button pulling out during operation is minimized. The die button typically includes a central aperture that is shaped substantially complementary to the punch. The aperture has generally been designed to extend all the way through the button, increasing in diameter toward the bottom of the button. Thus, when the punch is lowered into the die button, it pierces a slug from the workpiece, which falls through the button, to be discarded. The press fit interface between the die button and the main body die prevents the punch from withdrawing the button from the body die when retracting.

A related problem involves the challenge of initially placing and subsequently maintaining the die button in the appropriate rotational orientation. If the button aperture is not properly aligned with the punch, excessive wear or breakage of the tools can occur. Die builders often utilize a "dowel" for locating the die button, and preventing its rotation. In a typical design, a longitudinal groove is machined into the side of the button. A complementary groove is also formed in the wall of the bore that receives the button. During assembly, the dowel is inserted into the receiving slot defined by the button and the body die. Because a portion of the dowel is situated in the button and a portion is situated in the wall of the immovable die, the button is properly positioned and prevented from rotation relative to the die.

Over the years, many improvements in punch and die durability and materials have been developed. However, those skilled in the art will appreciate the beating that punch and die tools can take over the course of thousands of hits. Even with the hardest, precision-ground tools, the parts still need relatively frequent sharpening and maintenance, and can and do wear out. Because die buttons are typically press-fit into the main body die for secure retention, a longtime challenge to tool and die shops and die maintenance departments has been the removal of die buttons from the body dies when replacement or sharpening is necessary.

Die builders have taken two general approaches for mounting die buttons in the body dies, and the design style dictates to a large extent the technique used to remove the buttons. In one design, a removable section is machined proximate the die buttons. This removable section or retainer is removed from the main body die, and the buttons are typically removed by inverting the retainer and driving them out with a hammer and metal rod or with an arbor press. In designs wherein the button is not installed in a removable retainer, such as a large die post (which may be a large cast section the size of an automobile), the entire body die must be lifted by an overhead crane, inverted and the buttons forced out of the body die with a hammer, press, etc. In either system, substantial man-hours may be required to replace or sharpen a few die buttons. The punch is not usable during this process, and production is therefore obviously impossible. Various other techniques have been used to remove die buttons, however, most if not all take a considerable amount of time and effort. Moreover, these relatively inelegant techniques risk damage to the die button and the die sections themselves. Overall, maintenance associated with punch die buttons has heretofore been a woefully inefficient endeavor.

The present invention is directed to one or more of the shortcomings or limitations set forth above.

SUMMARY OF THE INVENTION

It is an object of the present invention to provide a simple and cost-efficient means for removing punching or stamping die buttons from a body die.

It is a further object of the present invention to provide a die button assembly that includes means for rotationally locating the die button relative to a body die, and for facilitating removal therefrom.

It is yet a further object of the present invention to provide for a method of removing die buttons via modification of existing die buttons.

In accordance with the foregoing and other objects, the present invention provides an improved die button assembly that includes a die button having a longitudinal groove and a volumetrically reduced region. The die button assembly further includes a puller member comprising a dowel having an internally threaded bore passing completely therethrough, and an integral foot portion adapted to extend under the die button for facilitating extraction thereof.

BRIEF DESCRIPTION OF THE DRAWINGS

FIG. 4 is a side view of a die button extractor tool according to another preferred embodiment of the present invention.

DETAILED DESCRIPTION

Figure 1:
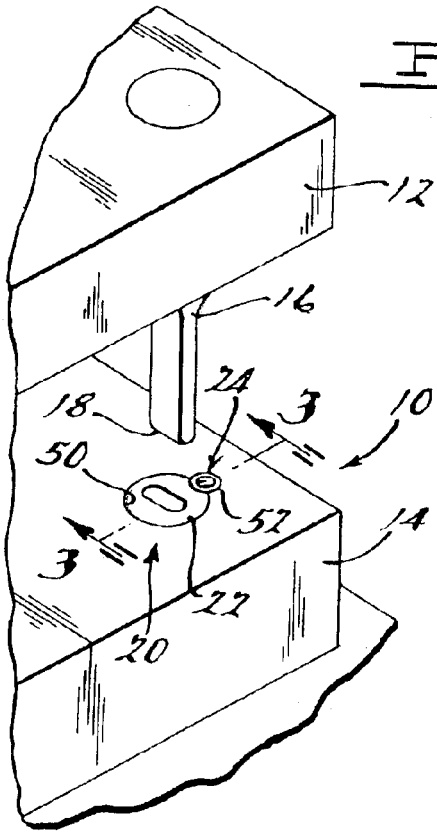
FIG. 1 is a perspective view of a punch and die button assembly according to the present invention.

The present invention provides a die button and related assembly for use with an industrial punch and die apparatus. Referring to FIG. 1, there is shown a perspective view of a punch assembly 10 in accordance with a preferred constructed embodiment of the present invention. Assembly 10 includes an upper die shoe 12 and a lower die shoe or body die 14. A reciprocable punch 16 is retained with upper die shoe 12 in a conventional manner, and is operable to pierce a workpiece (not shown in FIG. 1) that is passed underneath the punch 16 in a manner well known in the art. A die button assembly 20 is located in lower die shoe 14, and receives the working point 18 of punch 16. Die button assembly 20 includes a button 22 and a puller member 24. In one preferred embodiment, die button assembly 20 is press fit into a bore(s) in body die 14, however, those skilled in the art will appreciate that the present invention will find application to other designs wherein different styles of mounting/retaining the buttons within the body die or associated retainer are used. For example, other embodiments (not shown) could utilize a separate button retainer mounted within or on top of body die 14 rather than the illustrated design. Moreover, it should be appreciated that the particular punch/button design illustrated in FIG. 1 is not limiting, and the variety of punches or buttons that might be used in conjunction with the present invention is much broader. All the components of the present invention are made from known materials, and are manufactured by known processes. As is well known in the art, it is generally desirable to make the various punches, buttons, pullers, etc, described herein from a steel or iron alloy, which is preferably heat treated or otherwise processed to enhance its hardness and durability.

Figure 2:
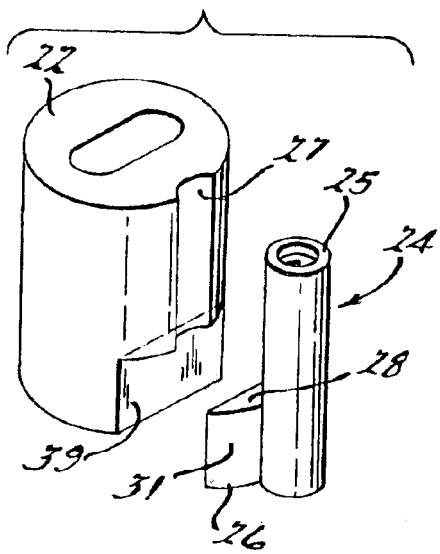
FIG. 2 is an exploded view of a die button and die button extractor tool according to a first preferred embodiment of the present invention.
Figure 3:
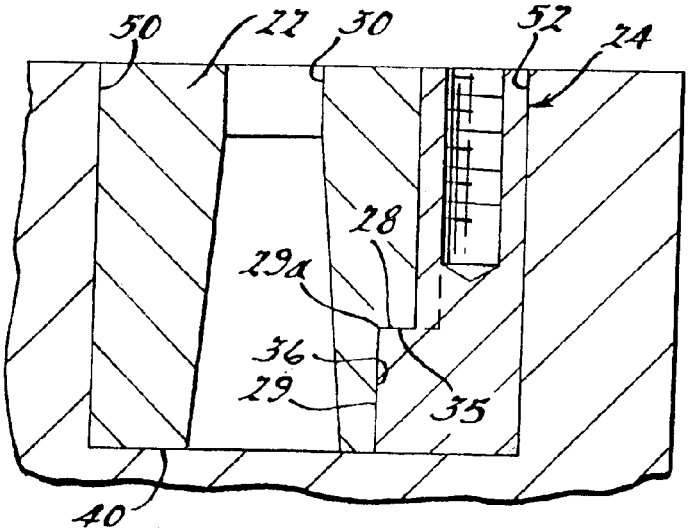
FIG. 3 is a sectioned side view of a die button and die button extractor tool similar to the embodiment of FIG. 2.

Turning also to FIGS. 2 and 3, there are shown exploded and sectioned views, respectively, of die button assemblies according to the present invention. In particular, FIG. 3 is a partial sectioned view of the apparatus pictured in FIG. 1, taken along line A—A. As illustrated in the drawing Figures, die button 22 preferably includes a central bore 30. In a preferred embodiment, the diameter of central bore 30 increases toward a bottom end 40 of button 22. Thus, when a punch such as punch 16 in FIG. 1 pierces a piece of stock in the apparatus, the increasing diameter of bore 30 allows the material slug created by punch 16 to readily fall out of the button. Various backing plugs or similar items (not shown in FIG. 3) may be positioned underneath button 22, however, illustration has been omitted from FIG. 3 for clarity.

FIGS. 2 and 3 also illustrate puller member 24. Puller member 24 serves the dual purposes of rotationally positioning button 22 and facilitating its extraction from the body die 14. Puller 24 includes an internally threaded dowel 25 that is integral with a foot 26. Dowel 25 is preferably substantially cylindrical, and can be threaded either right-handed or left-handed. As used herein, the term "integral" should be understood to mean that the dowel and foot are connected as a single piece. This includes designs wherein separate dowel and foot pieces are joined, as well as designs in which the dowel and foot are originally formed as a single member. Multiple piece embodiments (not shown), while contemplated, are not preferred. In a preferred embodiment, dowel 25 is substantially complementary with a longitudinal (vertical) cutout or groove 27 defined by button 22. This cutout 27 is preferably substantially arcuate in cross section, preferably approximately defining a portion of a circle. Returning to FIG. 1, there is illustrated the engaged dowel 25 and button 22. Button 22 is preferably substantially right circular, and is press fit into a cylindrical bore 50 in body die 14. A second, partially circular bore or groove 52 is formed in the wall of bore 50. Button 22 is preferably positioned in bore 50 such that its cutout 27 is aligned with groove 52, each of cutout 27 and groove 52 defining a portion of a cylinder that receives dowel 25. Thus, when dowel 25 is engaged in groove 27, and button 22 and dowel 25 are fit within their respective bores in body die 14, button 22 is prevented from rotating relative to body die 14 via its interface with dowel 25. Stated another way, when engaged, puller 24 and button 22 define a non-circular horizontal cross section that cannot rotate relative to body die 14.

Foot 26 extends outwardly from dowel 25, and preferably includes a substantially planar top face 28 that defines a plane oriented preferably substantially perpendicular to the orientation of dowel 25. Foot 26 also preferably includes a planar inner face 29 oriented substantially perpendicular to top face 28. It is preferred to grind or otherwise slightly reduce the upper edge (29*a* in FIG. 3) of side face 29, such that the transition from side face 29 is less abrupt than it would be with an unmodified edge. The outer face(s) 31 of foot 26 are preferably substantially arcuate. The thickness of foot 26 (as measured vertically, i.e. longitudinally of dowel 25) is preferably from about $1/5^{th}$ to about $3/5^{th}$s, most preferably about $2/5^{th}$s, the total vertical height of puller member 24. In one preferred embodiment, the various features of foot 26 are formed by "burning" a forged template by electrical discharge machining ("EDM"). In other preferred embodiments, the entire puller member 24 is forged having substantially its final desired shape. Other methods are contemplated for shaping foot 26, and the description herein should not be taken as limiting.

Cutout or groove 27 is preferably at least partially coextensive with a volumetrically reduced region 39, which is preferably a cutout region or flat machined on button 22. As used herein, the term "volumetrically reduced" refers to the removal of a volume of material from an otherwise cylindrical member (the button). The exact shape of the volumetrically reduced region 39 is not critical, and may be varied considerably. It is merely necessary that foot 26 be able to fit within the reduced region such that it can exert an upward force on button 22 when upward force is applied to dowel 25, as described below. The preferred reduced region 39 includes two substantially planar faces oriented at approximately 90°, and positioned proximate an end 40 of button 22. In an alternative embodiment (not shown), reduced region 39 is positioned medially of the end 40, and in axial cross section defines a shape having one straight side and one curved side, such as would result from grinding a flat at a medial position in a cylindrical member. Puller member 24 is preferably shaped such that dowel 25 and foot 26 are substantially complementary to volumetrically reduced region 39 and cutout 27, respectively, having the vertical cross section substantially as shown in FIG. 3. Other embodiments are contemplated (not shown) wherein foot 26 extends across a greater or lesser proportion of button 22 than the proportion illustrated in FIG. 3. In a preferred embodiment, button 22 defines a first radius that is greater than a second radius defined by foot 26. Stated another way, arcuate outer surfaces 31 may be thought of as forming a portion of the perimeter of a circle having a radius that is less than the radius of a circle defined by the perimeter or exterior surface of button 22. Similarly, the radius of the circle defined by a peripheral surface of dowel 25 proximate foot 26 is also preferably reduced relative to its respective bore/groove 52. Offsetting the radii makes it easier to press fit the button and puller assembly into the receiving bore. It is well known in the art to use electrical discharge machining, grinding, etching, etc. to reduce various regions of fitted parts to enhance the ease with which they are fitted together, and any of these and other, similar methods can be used to treat puller member 24 accordingly.

The buttons contemplated for use with the present invention are typically retrofitted to accommodate puller members. Typically, die buttons are substantially right cylindrical. In order to adapt commercially available die buttons for use with puller members of the present invention, the volumetrically reduced region is preferably ground from a standard die button. The button is preferably ground to include a flat oriented such that the longitudinal groove is aligned with substantially a longitudinal centerline of the flat, substantially as shown in FIG. 2. Many commercially available buttons already have the locating groove. The dimensions of the volumetrically reduced region are variable, however, in a preferred embodiment, the region is ground to accommodate a puller member according to the present invention and it is therefore desirable to form the flat such that the foot of the puller member mates substantially therewith. Rather than modifying commercially available buttons, however, die buttons could be manufactured according to the present invention by originally producing buttons with the desired shape.

When a die button becomes too worn to be of use and must be replaced or sharpened, or a new type of button is to be switched for the old ones, the present invention allows the buttons to be removed easily. Removal of a die button begins by screwing a threaded elongate member into threaded dowel 25. Once engaged therein, any of a variety of means can then be used for applying upward force to the dowel. For example, an apparatus similar to a dent puller for use with automobiles (for example a slide hammer) can be positioned on the body die, and then cranked to draw the threaded dowel upward. Such tools and apparatuses are well known. As the dowel is drawn upward, foot 26 engages the underside of button 22 (i.e. the horizontal face bounding reduced region 29), pulling the button upward and eventually freeing button 22 from its bore. A replacement button can then be pressed into the bore along with the same or a similar puller 24. Alternatives are contemplated wherein, for example, a motorized removal assembly is used to draw puller member 24 and button 22 upwardly and out of their bores.

The present invention offers a substantial advantage over many prior methods of removing die buttons. Not only is the process much faster, it does not require the use of heavy equipment, obviating safety and energy consumption concerns associated with the use of overhead cranes, presses, etc. previously used for removing die buttons. Further still, because it is unnecessary to use the relatively large forces required to remove buttons in previous methods, the present invention allows die buttons to be removed with reduced risk of damaging the buttons or supporting dies.

In related embodiments, the present invention includes a method of extracting a die button. The method preferably includes machining or otherwise forming a step on a die button. The step is preferably formed such that it includes a first face oriented substantially perpendicular to a long axis of the die button and having a second face oriented substantially parallel to a top face of the die button. The step is preferably adapted to matingly receive a puller member according to the present invention.

Referring now to FIG. 4, there is shown another preferred embodiment of the present invention. The FIG. 4 embodiment includes a puller member 224 that includes a dowel 225 and foot 226. A bore 229 is formed in dowel 225 and extends completely through dowel 225 from a first end 232 to a second end 242 and is at least partially threaded 231, the threads preferably extending along the entire length of bore 229. It should be appreciated that rather than threads 231 extending along the entire bore 229, only a portion of bore 229 need be threaded, as described below.

Member 224 is contemplated for use in applications substantially the same as the applications described with respect to the foregoing embodiments. In particular, member 224 is preferably used in conjunction with a die button such as die button 22 of FIGS. 1—3. Member 224 differs from the previously described embodiments mainly in that the dowel bore 229 preferably extends completely through the dowel, and threads 231 along bore 229 permit a threaded jacking tool (not shown) to be threaded into bore 229, and rotated to lift or jack member 224 and the associated die button out of a die block, such as die block 14 of FIG. 1. It is contemplated that rather than threading the tool into dowel 225, then pulling upward to pull the die button out, a rotation of the threaded tool will engage threads thereon with threads 231, and relative rotation therebetween will force member 224 upwardly. Thus, the threaded tool will preferably remain substantially fixed axially relative to the die block, and rotated relative thereto to extract the associated die button. It is therefore preferred to form bore 229 such that it extends completely through dowel 225, allowing a tip of the threaded tool (not shown) to pass all the way through bore 229 as the member 224 is jacked upward. It is accordingly unnecessary to thread the entire bore 229 so long as bore 229 has a sufficient internal diameter such that the threaded jacking tool can pass through the bore as it is engaged with threads 231. Stated another way, the minimum internal diameter of the bore at all points along its length should be greater than the internal diameter as measured between the inner grooves of threads 231, and denoted "D" in FIG. 4.

The present description is for illustrative purposes only, and should not be construed to limit the scope of the present invention in any way. Thus, those skilled in the art will appreciate that various modifications might be made to the presently disclosed embodiments without departing from the full and fair scope of the appended claims, and intended spirit of the invention. For example, rather than the described, relatively small extension of the foot under the die button, the puller member foot could extend under the entire die button. Similarly, rather than positioning the volumetrically reduced region for receipt of the foot at the end of the button, the region could be positioned medially at a point along the vertical length of the button, and the foot inserted therein. Further still, the shape of the volumetrically reduced region need not be a flat, as described. The reduced region might be wedge-shaped or of some other design such as a radial reduction having a rounded inner surface rather than a flat. Other aspects, features and advantages will be apparent upon an examination of the attached drawing Figures and appended claims.

What is claimed is:

1. A jacking tool for removing a die button in a body die comprising:

an elongate substantially cylindrical dowel having first and second ends and an internally threaded bore extending between and opening at both of said ends; and a foot integral with said dowel and positioned proximate an end thereof, said foot having a top face adapted to engage a substantially complementary surface on a die button.

2. The jacking tool of claim 1 wherein said bore is internally threaded substantially along an entire length thereof.

3. The jacking tool of claim 1 wherein said foot comprises arcuate outer faces oriented substantially perpendicular to said top face.

4. The jacking tool of claim 3 wherein said top face is oriented perpendicular an orientation of said dowel.

5. The jacking tool of claim 1 wherein said bore includes a threaded portionand an unthreaded portion; and wherein a diameter of said unthreaded portion does not exceed a distance between opposed thread grooves in said threaded portion.

6. A method of extracting a die button from a body die comprising the steps of:

forming a step on a substantially cylindrical die button, wherein the step comprises a substantially planar face oriented substantially parallel with a top face of the die button; and extracting the die button with a jacking member having a foot positionable against the substantially planar face.

7. The method of claim 6 wherein the step of forming a step comprises positioning the substantially planar face proximate an end of the die button opposite said top face.

8. The method of claim 7 further comprising the step of:

threadably engaging an elongate threaded member in bore in the jacking member; and providing force to the jacking member via an interface of threads on the elongate threaded member therewith to lift said die button from the body die.

9. The method of claim 8 wherein the step of providing force to the jacking member comprises:

exerting an axial pulling force on a dowel of the jacking member substantially without relative rotation between said dowel and said elongate threaded member.

10. The method of claim 8 wherein the step of providing a force to the jacking member comprises:

exerting an axial pulling force on a dowel of the jacking member by rotating the elongate threaded member relative thereto substantially without relative axial displacement between said elongate threaded member and the body die, thereby jacking the die button from the body die.

11. The method of claim 7 further comprising the steps of:

inserting an elongate member into a bore in the jacking member, and engaging the elongate member therein; and providing an upward force on the jacking member via the elongate member, thereby lifting the die button from the body die.

12. A button assembly for a metal stamping or punching apparatus having a reciprocable punch and a body die, the button assembly comprising:

a button positioned in the body die, said button having a locating groove and a volumetrically reduced region; and a jacking member engageable with said button, said jacking member comprising a foot that extends into said volumetrically reduced region, and a dowel complementary with said groove;

wherein said dowel comprises a bore extending completely therethrough said dowel being adapted to threadedly receive an elongated member for providing an upward force to said dowel, thereby extracting said button via said foot from the body die.

13. The button assembly of claim 12 wherein said foot includes a substantially planar top face and an inner face perpendicular to said top face, said foot further including arcuate outer faces.

14. The button assembly of claim 12 wherein an exterior surface of said button defines a first radius, and wherein said foot defines a second radius that is smaller than said first radius.

15. The button assembly of claim 12 wherein the button is substantially cylindrical and includes a first end having a shaped recess for receipt of a substantially complementary punch; and wherein the volumetrically reduce region is located at a second end of the button opposite said first end and is a substantially right-angled step.

16. The button assembly of claim 12 wherein the button comprises first and second locating grooves positioned on substantially opposite sides thereof.

* * * * *